US011821587B2

(12) United States Patent
Oulalite et al.

(10) Patent No.: US 11,821,587 B2
(45) Date of Patent: Nov. 21, 2023

(54) SEALED AND THERMALLY INSULATING TANK

(71) Applicant: GAZTRANSPORT ET TECHNIGAZ, Saint Rémy lès Chevreuse (FR)

(72) Inventors: Mohammed Oulalite, Saint Rémy lès Chevreuse (FR); Pierre Charbonnier, Plourin (FR); Mohamed Sassi, Saint Rémy lès Chevreuse (FR); Marc Boyeau, Saint Rémy lès Chevreuse (FR); Bruno Deletre, Saint Rémy lès Chevreuse (FR); Raphaël Prunier, Saint Rémy lès Chevreuse (FR)

(73) Assignee: GAZTRANSPORT ET TECHNIGAZ, Saint Rémy lès Chevreuse (FR)

( * ) Notice: Subject to any disclaimer, the term of this patent is extended or adjusted under 35 U.S.C. 154(b) by 334 days.

(21) Appl. No.: 17/263,419

(22) PCT Filed: Jul. 25, 2019

(86) PCT No.: PCT/FR2019/051847
§ 371 (c)(1),
(2) Date: Jan. 26, 2021

(87) PCT Pub. No.: WO2020/021208
PCT Pub. Date: Jan. 30, 2020

(65) Prior Publication Data

US 2021/0140586 A1 May 13, 2021

(30) Foreign Application Priority Data

Jul. 26, 2018 (FR) ..... 1856973

(51) Int. Cl.
*F17C 3/02* (2006.01)

(52) U.S. Cl.
CPC ..... *F17C 3/027* (2013.01); *F17C 2201/0157* (2013.01); *F17C 2201/052* (2013.01);
(Continued)

(58) Field of Classification Search
CPC .. F17C 3/027; F17C 3/02; F17C 3/025; F17C 2003/0358; F17C 2270/0107; F17C 1/12;
(Continued)

(56) References Cited

U.S. PATENT DOCUMENTS 10,139,048 B2 11/2018 Sassi et al.
2007/0246473 A1* 10/2007 Yang ..... F17C 13/001 29/428
2013/0255562 A1* 10/2013 Canler ..... F17C 3/027 62/53.2

FOREIGN PATENT DOCUMENTS

CN 107850265 A 3/2018
EP 1847758 A2 10/2007
(Continued)

OTHER PUBLICATIONS

First Office Action in connection with Chinese Patent Application No. 201980049866.2 dated Dec. 13, 2021, 13 pages.
(Continued)

*Primary Examiner* — Stephen J Castellano

(57) ABSTRACT

A tank includes a secondary insulation barrier, a secondary sealing membrane resting on the secondary insulation barrier, a primary insulation barrier resting on the secondary sealing membrane, a primary sealing membrane resting on the primary insulation barrier, and a primary reinforcing member. The primary sealing membrane includes primary corrugations and the secondary sealing membrane includes secondary corrugations projecting toward the interior of the tank. The primary and secondary corrugations are superimposed along a thickness direction. The primary insulation barrier has passages, and the secondary corrugations are
(Continued)

accommodated in the passages. A dimension of the primary insulation barrier is less than a dimension of the secondary corrugations along the thickness direction, so the secondary corrugations extend through the passages and are partially accommodated in the primary corrugations. The primary reinforcing member is interposed along the thickness direction between superimposed primary and secondary corrugations so as to reinforce the primary corrugation.

32 Claims, 3 Drawing Sheets

(52) U.S. Cl.
CPC ..... *F17C 2203/0358* (2013.01); *F17C 2221/033* (2013.01); *F17C 2223/0161* (2013.01); *F17C 2223/033* (2013.01); *F17C 2260/011* (2013.01); *F17C 2270/0107* (2013.01)

(58) Field of Classification Search
CPC ..... F17C 1/08; F17C 1/02; F17C 7/02; F17C 2260/011
See application file for complete search history.

(56) References Cited

FOREIGN PATENT DOCUMENTS

| | | | |
|---|---|---|---|
| FR | 2936784 | A1 | 4/2010 |
| KR | 10-2010-0060348 | A | 6/2010 |
| KR | 10-2015-0140466 | A | 12/2015 |

OTHER PUBLICATIONS

International Search Report of the International Searching Authority in connection with International Patent Application No. PCT/FR2019/051847 dated Nov. 18, 2019, 5 pages.
Written Opinion of the International Searching Authority in connection with International Patent Application No. PCT/FR2019/051847 dated Nov. 18, 2019, 12 pages.

* cited by examiner

SEALED AND THERMALLY INSULATING TANK

CROSS-REFERENCE TO RELATED APPLICATIONS AND PRIORITY CLAIM

This application in the national stage (Rule 371) of international application No. PCT/FR2019/05 1847 filed on Jul. 25, 2019. This application claims priority under 35 U.S.C. § 365 to International Patent Application No. PCT/FR2019/05 1847 filed on Jul. 25, 2019, which claims priority to French Patent Application No. 1856973 filed on Jul. 26, 2018. Both of these applications are hereby incorporated by reference in their entirety.

TECHNICAL FIELD

The invention relates to the field of sealed and thermally insulating tanks. In particular, the invention relates to the field of sealed and thermally insulating tanks for storing and/or transporting liquefied gas at low temperature, such as tanks for transporting liquefied petroleum gas (also known as LPG) having, for example, a temperature of between −50 ° C. and 0° C., or for transporting liquefied natural gas (LNG) at about −162° C. at atmospheric pressure. These tanks may be installed on land or on a floating construction. In the case of a floating construction, the tank may be intended for transporting liquefied gas or for receiving liquefied gas, which is used as fuel for the propulsion of the floating construction.

In one embodiment, the liquefied gas is LNG, i.e. a mixture which has a high methane content and is stored at a temperature of about −162° C. at atmospheric pressure. Other liquefied gases may also be envisioned, in particular ethane, propane, butane or ethylene. Liquefied gases may also be stored under pressure, for example at a relative pressure of between 2 and 20 bar, and in particular at a relative pressure of close to 2 bar. The tank may be produced according to various techniques, particularly in the form of a tank integrated with a membrane.

TECHNOLOGICAL BACKGROUND

A sealed and thermally insulating tank for transporting cryogenic liquid, for example LNG, is for example installed in a space formed by the internal hull of a double-hulled ship. Such a tank has a multilayer structure making it possible to ensure both insulation and sealing of the tank. The tank thus comprises, from the exterior of the tank toward the interior of the tank, a secondary insulation barrier, a secondary sealed membrane, a primary insulation barrier, and a primary sealed membrane intended to be in contact with the cryogenic liquid contained in the tank. This multilayer structure makes it possible to ensure that, even in the event of degradation of the primary sealed membrane, because of the secondary insulating barrier and the secondary sealed membrane the tank maintains sufficient sealing and insulation so that the cryogenic liquid does not damage the structure in which the tank is integrated, typically the double hull of the ship.

In a multilayer tank system as described in document US2017/0159888 A1 only the secondary insulation barrier has insulating characteristics sufficient to ensure insulation of the tank. In such a tank, the primary insulation barrier principally has a function of separating the secondary sealed membrane and the primary sealed membrane, rather than an insulation function. In such a tank, the primary insulation barrier is formed, for example, by plywood plates having a limited thickness.

Furthermore, the primary sealed membrane has corrugations. Such corrugations allow the primary sealed membrane to deform under stresses, for example in the event of temperature changes in the tank due to loading or unloading of cryogenic liquid in the tank, or in order to withstand the deformations of the supporting structure in the swell.

Since the primary insulation barrier has limited insulation characteristics, the secondary sealed membrane and the primary sealed membrane have similar operating temperatures. Thus, in the absence of leaks in the primary sealed membrane, the secondary sealed membrane is subjected to stresses, associated with the temperature changes in the tank, which are similar to the stresses experienced by the primary sealed membrane. Consequently, the secondary sealed membrane also has corrugations making it possible to absorb the deformations generated by the temperature changes in the tank, or in order to withstand the deformations of the supporting structure in the swell.

The plywood plates forming the primary insulation barrier have passages making it possible to accommodate these corrugations of the secondary sealed membrane. Furthermore, because of the limited thickness of the primary insulation barrier, the corrugations of the secondary membrane and the corrugations of the primary membrane are superimposed so as to accommodate the corrugations of the secondary sealed membrane at least partially in the corrugations of the primary sealed membrane.

SUMMARY

One underlying concept of the invention is to provide a sealed and thermally insulating tank which has good stress resistance characteristics. One underlying concept of the invention is to provide a sealed and thermally insulating tank, the primary sealed membrane of which is reinforced. One underlying concept of the invention is to provide a sealed and thermally insulating tank, of which the corrugations of the primary sealed membrane are reinforced.

According to one embodiment, the invention provides a sealed and thermally insulating tank intended to be installed in a supporting structure, said tank comprising, from the exterior of the tank toward the interior of the tank, a secondary insulation barrier intended to be anchored on the supporting structure, a secondary sealing membrane resting on the secondary insulation barrier, a primary insulation barrier resting on the secondary sealing membrane, and a primary sealing membrane resting on the primary insulation barrier, the primary sealing membrane comprising primary corrugations projecting toward the interior of the tank, the secondary sealing membrane comprising secondary corrugations projecting toward the interior of the tank, the primary corrugations and the secondary corrugations being superimposed along a thickness direction, the primary insulation barrier having passages, the secondary corrugations being accommodated in said passages, the dimension of the primary insulation barrier along the thickness direction being less than the dimension of the secondary corrugations taken along said thickness direction, so that the secondary corrugations extend through the passages and are partially accommodated in the primary corrugations, the tank furthermore comprising a primary reinforcing member interposed along the thickness direction between a superimposed secondary corrugation and primary corrugation so as to reinforce said primary corrugation.

By virtue of these characteristics, the primary corrugations are reinforced by the primary reinforcing member, thus increasing the resistance of the primary sealed membrane to pressure forces.

According to some embodiments, such a sealed and thermally insulating tank may have one or more of the following characteristics.

According to one embodiment, the primary and secondary sealing membranes each comprise planar portions located between the corrugations and respectively rest on the primary insulation barrier and the secondary insulation barrier.

According to one embodiment, the primary reinforcing member has a concave bearing surface, the concavity of which faces toward the secondary corrugation, said bearing surface matching an internal face of the secondary corrugation located opposite.

According to one embodiment, the bearing surface has a radius of curvature identical or similar to the radius of curvature of the internal face of the secondary corrugation.

According to one embodiment, the radius of curvature of the bearing surface is such that the bearing surface partially, for example at least 50%, covers the internal surface of the secondary corrugation. According to one embodiment, the bearing surface covers in particular the portion of the secondary corrugation which projects into the primary corrugation.

According to one embodiment, the bearing surface bears on an apex of the secondary corrugation.

According to one embodiment, a clearance separates the primary reinforcing member and a base of the secondary corrugation, said base of the secondary corrugation being contiguous with planar portions of the secondary sealed membrane. Such a clearance allows deformation of the base of the secondary corrugation, for example in the presence of tensile forces on said secondary corrugation which are due to the thermal contraction or the elongation of the hull girder or for mounting tolerances.

According to one embodiment, the radius of curvature of the bearing surface is identical to the radius of curvature of the internal surface of the secondary corrugation, so that the bearing surface entirely covers the internal face of the secondary corrugation.

By virtue of these characteristics, the primary reinforcing member cooperates stably and reliably with the secondary corrugation in order to offer effective reinforcement of the primary corrugation.

According to one embodiment, the primary reinforcing member has a convex reinforcing surface, the convexity of which faces toward the primary corrugation and has a radius of curvature matching the radius of curvature of an external face of the primary corrugation.

According to one embodiment, a clearance separates the reinforcing surface from the external face of the primary corrugation at ambient temperature.

According to one embodiment, the radius of curvature of the reinforcing surface is identical to the radius of curvature of the external face of the primary corrugation on a portion of said external face in line with an apex of the primary corrugation. According to one embodiment, said portion of the external face of the primary corrugation is delimited on either side of the apex of the primary corrugation by points of inflection of said external face.

By virtue of these characteristics, the primary reinforcing member ensures uniform, reliable and effective reinforcement of the primary corrugation.

According to one embodiment, the primary corrugation and the secondary corrugation are superimposed along the thickness direction, so that an apex of the secondary corrugation is arranged in line with an apex of the primary corrugation.

According to one embodiment, the thickness of the primary reinforcing member decreases in the direction of the lateral ends of said primary reinforcing member.

According to one embodiment, the reinforcing surface and the bearing surface are contiguous at said lateral ends of the primary reinforcing member. According to one embodiment, the ends of the reinforcing surface and of the bearing surface are connected by a connecting surface of the primary reinforcing member.

According to one embodiment, the primary reinforcing member is hollow. According to one embodiment, the hollow primary reinforcing member comprises internal reinforcing webs.

Such a primary reinforcing member has a high structural strength allowing reliable and effective reinforcement of the primary corrugation. Furthermore, such a hollow reinforcing member allows the circulation of gas between the primary corrugation and the secondary corrugation, for example an inert gas such as nitrogen.

According to one embodiment, the reinforcing webs extend perpendicularly to the internal face of the secondary corrugation. According to one embodiment, the reinforcing webs extend perpendicularly to the external face of the primary corrugation.

According to one embodiment, the tank furthermore comprises a holding device arranged to exert a purchase on the primary reinforcing member in the direction of the secondary corrugation so as to keep said primary reinforcing member bearing against said secondary corrugation.

According to one embodiment, the holding device comprises a flexible member anchored on the primary insulation barrier and connected to the primary reinforcing member so as to exert the purchase force in the direction of the secondary corrugation on said primary reinforcing member.

According to one embodiment, the holding device comprises a flexible band having a first end anchored on the primary insulation barrier on one side of the primary reinforcing member, a second end anchored on the primary insulation barrier on the other side of the primary reinforcing member, and a central portion interposed between the primary reinforcing member and the primary corrugation.

According to one embodiment, the flexible band is anchored to the primary insulation barrier by fasteners, for example staples, screws, nails or the like.

According to one embodiment, the flexible member is resilient. According to one embodiment, the holding device comprises a resilient blade. According to one embodiment, the ends of the resilient blade form feet held resiliently against the primary insulation barrier on either side of the secondary corrugation.

According to one embodiment, the resilient blade is anchored to the primary insulation barrier by friction.

According to one embodiment, the primary reinforcing member comprises a pair of feet projecting laterally from the ends of the primary reinforcing member, said feet being accommodated in respective bores of the primary insulation barrier so as to block the primary reinforcing member in displacement along the thickness direction of the tank.

By virtue of these characteristics, the primary reinforcing member is held in position by the primary insulation barrier. Thus, the reinforcing member is stable and reinforces the primary corrugation reliably.

According to one embodiment, the primary insulation barrier comprises a plurality of panels interposed between planar portions of the primary sealed membrane and of the secondary sealed membrane. According to one embodiment, these panels are made of wood, for example plywood.

According to one embodiment, the bores are formed on an external face of the primary insulation barrier resting against the secondary sealing membrane, so that the feet of the primary reinforcing member are interposed along the thickness direction between the primary insulation barrier and the secondary sealing membrane.

According to one embodiment, the tank furthermore comprises a secondary reinforcing member interposed along the thickness direction of the tank between a secondary corrugation and the secondary insulation barrier so as to reinforce said secondary corrugation.

According to one embodiment, the secondary reinforcing member has an external shape matching the internal shape of a portion of the secondary corrugation which projects into the primary corrugation.

Thus, the secondary reinforcing member reinforces the projecting portion of the secondary corrugation completely and uniformly.

According to one embodiment, the secondary reinforcing member is hollow so as to allow circulation of gas, for example inert gas, under the secondary corrugation. According to one embodiment, the secondary reinforcing member comprises internal webs, such internal webs structurally reinforcing said secondary reinforcing member.

By virtue of these characteristics, the secondary corrugation is also reinforced. Furthermore, the secondary corrugation reinforced in this way serves to support the primary reinforcing member so that the primary reinforcing member ensures better reinforcement of the primary corrugation.

Such a tank may form part of an onshore storage facility, for example for storing LNG, or it may be installed in a coastal or deep-water floating structure, in particular a methane carrier ship, a floating storage and regasification unit (FSRU), a floating production storage and offloading (FPSO) unit and the like. Such a tank may also be used as a fuel reservoir in any type of ship.

According to one embodiment, a ship for transporting a cold liquid product comprises a double hull and a tank as mentioned above arranged in the double hull.

According to one embodiment, the invention also provides a method for loading or unloading such a ship, in which a cold liquid product is conveyed through insulated pipelines from or to a floating or onshore storage facility to or from the tank of the ship.

According to one embodiment, the invention also provides a transfer system for a cold liquid product, the system comprising the ship as mentioned above, insulated pipelines arranged so as to connect the tank installed in the hull of the ship to a floating or onshore storage facility, and a pump for delivering a flow of cold liquid product through the insulated pipelines from or to the floating or onshore storage facility to or from the hull of the ship.

Some aspects of the invention are based on the idea of reinforcing the primary corrugations of a sealed and thermally insulating tank in which the corrugations of the primary sealed membrane and the corrugations of the secondary sealed membrane are superimposed. Some aspects of the invention are based on the idea of reinforcing a primary corrugation, the internal space of which is at least partially occupied by a secondary corrugation. Some aspects of the invention are based on the idea of reinforcing a primary corrugation opposite a curved surface formed by a secondary corrugation.

BRIEF DESCRIPTION OF THE FIGURES

The invention will be understood better, and further objects, details, characteristics and advantages thereof will become dearer during the following description of several particular embodiments of the invention, which are given only by way of illustration and without limitation, with reference to the appended drawings.

DETAILED DESCRIPTION OF EMBODIMENTS

In the description below, reference is made to a sealed and thermally insulating tank comprising an internal space intended to be filled with combustible or noncombustible gas. The gas may in particular be a liquefied natural gas (LNG), that is to say a gas mixture mainly comprising methane as well as one or mare other hydrocarbons such as ethane, propane, n-butane, i-butane, n-pentane, i-pentane, neopentane and nitrogen, in a low proportion. The gas may also be ethane or a liquefied petroleum gas (LPG), that is to say a mixture of hydrocarbons which is obtained by refining petroleum and essentially comprises propane and butane.

Figure 1:
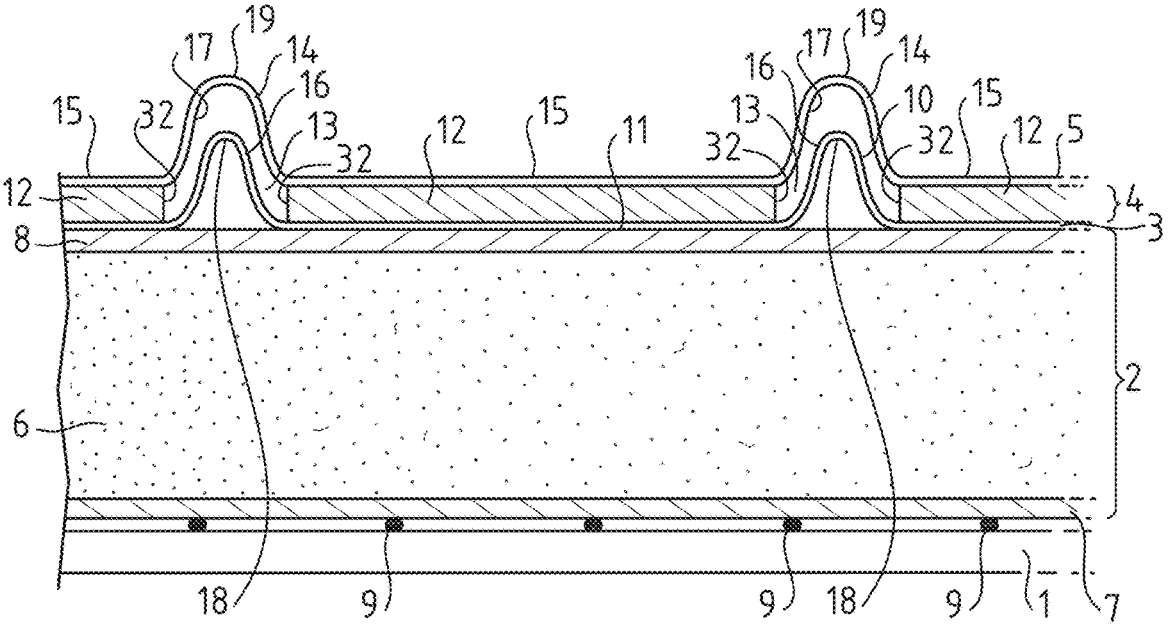
FIG. 1 is a partial sectional view of a sealed and thermally insulating tank.

Such a sealed and thermally insulating tank is integrated in a supporting structure 1, for example the double hull of a ship for transporting LNG. This supporting structure 1 defines a plurality of supporting walls jointly delimiting an internal space of the double hull, which is intended to receive the sealed and thermally insulating tank. The sealed and thermally insulating tank comprises a plurality of tank walls, each supported by a respective supporting wall of the supporting structure 1. Each tank wall has a multilayer structure comprising, from the corresponding supporting wall to the interior of the tank, a secondary thermally insulating barrier 2, a secondary sealed membrane 3, a primary thermally insulating barrier 4, and a primary sealed membrane 5 which delimits the interior of the tank and is intended to be in contact with the liquid contained in the tank. FIG. 1 partially illustrates a sealed and thermally insulating tank wall according to this multilayer structure.

The secondary thermally insulating barrier 2 comprises an insulating packing 6 sandwiched between a bottom plate 7 and a cover plate 8. The insulating packing 6 is, for example, a fiber-reinforced or unreinforced polyurethane foam. The bottom plate 7 and the cover plate 8 are rigid plates, for example plywood plates.

The secondary thermally insulating barrier 2 may be produced in a number of ways, for example by means of insulating panels of parallelepipedal shape juxtaposed according to a regular pattern on a corresponding supporting wall of the supporting structure 1. These insulating panels are anchored on the supporting structure 1 by means of anchoring members (not illustrated). Lines of mastic 9 are interposed between the bottom plate 7 and the supporting structure 1 in order to compensate for the planarity defects of the supporting structure 1. The secondary thermally insulating barrier 2 thus forms a planar support surface on which the secondary sealed membrane 3 rests.

The secondary sealed membrane 3 comprises a plurality of corrugated metal plates. These metal plates are welded to one another in order to form the secondary sealed membrane 3. This secondary sealed membrane 3 may be anchored on the supporting structure in a number of ways. For instance, the secondary sealed membrane 3 may be anchored on the supporting structure indirectly by being anchored on the secondary thermally insulating barrier 2, or directly by being anchored on anchoring members (not illustrated) extending through the secondary thermally insulating barrier 2.

The secondary sealed membrane 3 comprises corrugations 10, hereafter secondary corrugations 10, projecting toward the interior of the tank. These secondary corrugations 10 make it possible to absorb the deformations of the secondary sealed membrane 3, for example associated with the temperature changes in the tank or with the deformation of the hull girder of the ship. The secondary sealed membrane 3 comprises a first series of mutually parallel secondary corrugations 10 extending parallel to a first direction, for example a longitudinal direction of the ship. The secondary sealed membrane 3 comprises a second series of mutually parallel secondary corrugations 10 extending parallel to a second direction, for example a transverse direction of the ship. The secondary sealed membrane 3 comprises planar portions 11, hereafter secondary planar portions 11, interposed between adjacent secondary corrugations 10.

The primary thermally insulating barrier 4 has a smaller thickness than the secondary thermally insulating barrier 2. The primary thermally insulating barrier 4 comprises a plurality of rigid plates 12 resting on the secondary sealed membrane 3. More particularly, as illustrated in FIG. 1, the rigid plates 12 of the primary thermally insulating barrier 4 rest on the planar portions 11 of the secondary sealed membrane 3. The primary thermally insulating barrier 4 comprises a plurality of passages 13 in which the secondary corrugations 10 are accommodated. These passages 13 are, for example, delimited by side edges 32 of the rigid plates 12 located on either side of the secondary corrugations 10.

The rigid plates 12 have a thickness, taken along the thickness direction of the corresponding tank wall, which is less than the height of the secondary corrugations 10 taken along said thickness direction. Thus, the secondary corrugations 10 extend through the passages 13 of the primary thermally insulating barrier 4 and project toward the interior of the tank, beyond the primary thermally insulating barrier 4. By way of example, the thickness of the rigid plates 12 is between 9 and 36 mm, preferably between 12 and 24 mm.

The rigid plates 12 of the primary thermally insulating barrier 4 form a primary planar support surface on which the primary sealed membrane 5 rests. In a similar ay to the secondary sealed membrane 3, the primary sealed membrane 5 comprises a plurality of corrugated metal plates connected to one another in a sealed manner, for example by welding. Likewise, this primary sealed membrane 5 may be anchored to the supporting structure 1 indirectly by being anchored to the primary thermally insulating barrier 4, or directly by being anchored to the supporting structure via an anchoring member, in which case said anchoring membrane may be common to the anchoring of the secondary sealed membrane 3 and of the primary sealed membrane 5.

The primary sealed membrane 5 comprises corrugations 14, hereafter primary corrugations 14, for absorbing the deformations of the primary sealed membrane 5. In a similar way to the secondary sealed membrane 3, the primary sealed membrane 5 comprises a first series of mutually parallel primary corrugations 14 and a second series of mutually parallel primary corrugations 14. The primary sealed membrane furthermore comprises planar portions 15, hereafter primary planar portions 15, interposed between the primary corrugations 14.

FIG. 1 illustrates a sectional view of the tank wall, so that only secondary corrugations 10 of the first series of secondary corrugations 10 and primary corrugations 14 of the first series of primary corrugations are represented in section. Nevertheless, the description below applies similarly to all the secondary corrugations 10 and primary corrugations 14 of the primary sealed membrane 5 and secondary sealed membrane 3.

The primary corrugations 14 are arranged in line with the secondary corrugations 10. Thus, the portions of the secondary corrugations 10 projecting from the primary thermally insulating barrier 4 are accommodated in the primary corrugations 14 with which they are superimposed. More particularly, the secondary corrugations 10 have an internal surface 16 opposite an external surface 17 of the corresponding primary corrugations 14. The primary 14 and secondary 10 corrugations project toward the interior of the tank, the internal surface 16 of the secondary corrugation 10 has a convex shape and the external surface 17 of the primary corrugation 14 has a concave shape. The secondary corrugations 10 are centered in the primary corrugations 14 so that an apex 18 of the secondary corrugations 10 is located in line with an apex 19 of the primary corrugations 14. Thus, the primary corrugations 14 and the secondary corrugations 10 are symmetrical with respect to a plane passing through the apices 18 and 19 and extending parallel to the longitudinal direction of said corrugations 10, 14.

This superimposition of the primary corrugations 14 and the secondary corrugations 10 makes it possible to position the primary planar portions 15 in line with the secondary planar portions 11. Thus, the primary planar portions 15 may rest on the primary thermally insulating barrier 4 formed by the rigid plates 12 and arranged on the secondary planar portions 11.

The metal plates forming the primary 5 and secondary 3 sealed membranes may in particular be made of stainless steel, aluminum, Invar®: that is to say an alloy of iron and nickel whose coefficient of expansion is typically between $12.10^{-6}$ and $2.10^{-6}$ $K^{-1}$, or from an alloy of iron with a high manganese content whose coefficient of expansion is typically of the order of $7.10^{-6}$ $K^{-1}$. Other metals or alloys are, however, also possible.

By way of example, the metal plates may have a thickness of between 1 mm and 1.6 mm. Other thicknesses may also be envisioned, bearing in mind that thickening the metal sheet leads to an increase in its cost and generally increases the rigidity of the corrugations 10, 14.

Other possible details and characteristics of the sealed membranes, of the metal plates forming said sealed membranes, and of the anchoring of the thermally insulating barriers or of the sealed membranes are described in document US2017/0159888 or WO2016021948. By way of example, the metal plates assembled in order to form the sealed membranes 3, 5 may be shaped by pressing or folding.

The corrugations 10, 14 make it possible for the sealed membranes 3, 5 to be flexible so that they can deform under the effect of the thermal and mechanical stresses generated by the LNG in the tank. Specifically, loading the tank with a cryogenic liquid such as LNG leads to a significant temperature change generating significant thermal contraction stresses in the primary sealed membrane 5. These thermal stresses are also present at the secondary sealed membrane 3, the primary thermal insulation barrier 4 having a thickness that does not make it possible to attenuate these thermal stresses. Furthermore, the movements of liquid in the tank, particularly in the case of a ship sailing at sea, may lead to significant stresses on the primary sealed membrane 5, particularly at the primary corrugations 14 which project inside the tank. Another deformation factor of the sealed membranes 3, 5 is the elongation of the hull girder of a ship in response to the movements of the ship on the swell.

Figure 2:
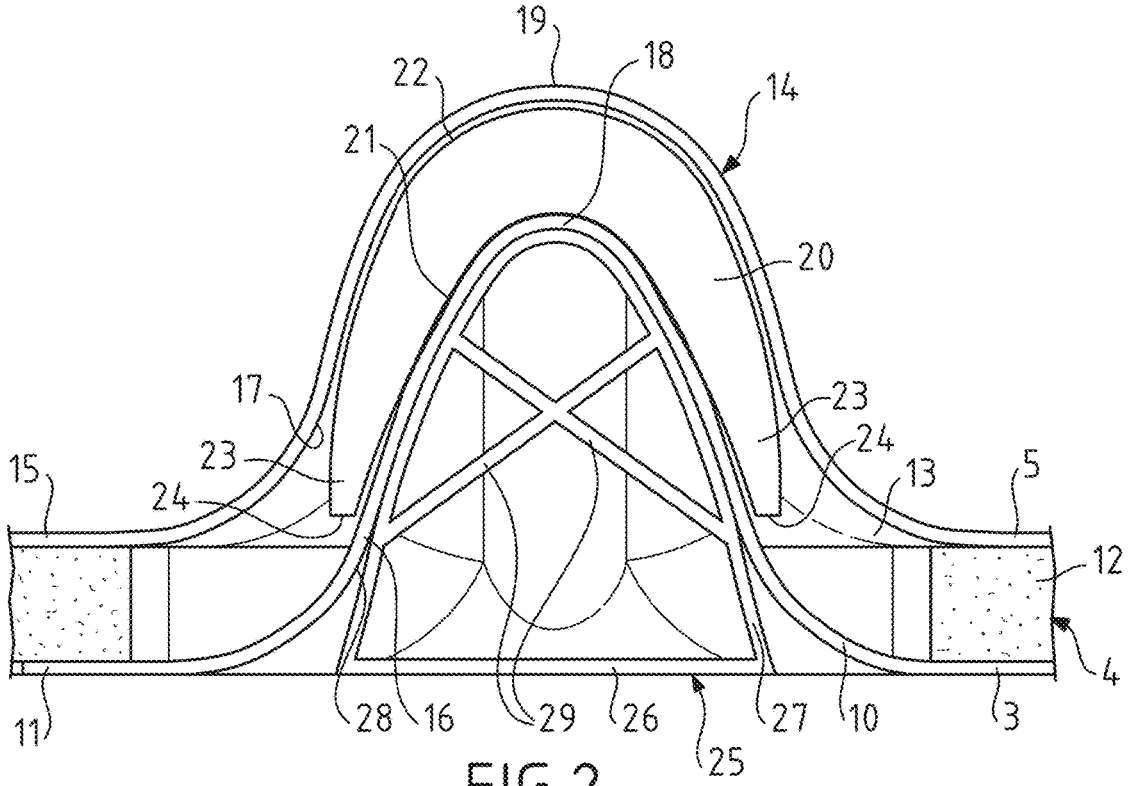
FIG. 2 is a detail sectional view of a sealed and thermally insulating tank as illustrated in FIG. 1, furthermore comprising a primary reinforcing member according to a first embodiment.

FIG. 2 illustrates a portion of a sealed and thermally insulating tank as described above, furthermore comprising a primary reinforcing member 20 according to a first embodiment. Such a primary reinforcing member 20 makes it possible to reinforce the primary sealed membrane 5, and in particular the primary corrugations 14, in relation to the various stresses experienced by said primary sealed membrane 5. This FIG. 2 illustrates the tank wall and the primary reinforcing member 20 at a single primary corrugations 14 and a single secondary corrugation 10, although the description below may apply to one, several or all of the primary 14 and secondary 10 corrugations of the tank.

As illustrated in FIG. 2, the primary reinforcing member 20 is interposed between the primary sealed membrane 5 and the secondary sealed membrane 3. More particularly, since the primary corrugation 14 and the secondary corrugation 10 are superimposed, the primary reinforcing member 20 is interposed between the internal face 16 of the secondary corrugation 10 and the external face 17 of the primary corrugation 14.

The primary reinforcing member 20 has a bearing surface 21 and a reinforcing surface 22. In a similar way to the primary 14 and secondary 10 corrugations, the primary reinforcing member 20 is symmetrical with respect to the plane passing through the apices 18, 19 of the corrugations 10, 14 and extending parallel to the longitudinal direction of the corrugations 10, 14. Likewise, the bearing 21 and reinforcing 22 surfaces are symmetrical with respect to said plane.

The bearing surface 21 faces toward the internal face 16 of the secondary corrugation 10. This bearing surface 21 has a concave shape, the concavity of which faces toward the internal face 16 of the secondary corrugation 10. Thus, the bearing surface 21 has a shape complementary to the shape of the internal face 16 of the secondary corrugation 10.

Preferably, the bearing surface 21 covers the internal face 16 of the secondary corrugation 10 with contact over at least 50% of said internal face 16. To this end, the radius of curvature of the bearing surface 21 is similar to the radius of curvature of the internal face 16 of the secondary corrugation 10. More particularly, the bearing surface 21 has a central portion containing the middle of said bearing surface 21. This central portion of the bearing surface 21 has a radius of curvature identical to the radius of curvature of a central portion of the internal face 16 of the secondary corrugation 10. In other words, the central portion of the bearing surface 21 covers and is in contact with the central portion of the internal face 16 of the secondary corrugation 10.

The central portion of the internal face 16 of the secondary corrugation 10 contains the apex 18 of the secondary corrugation 10 and extends on either side of said apex 18 symmetrically with respect to the plane of symmetry of the secondary corrugation 10. Likewise, the central portion of the bearing surface 21 is symmetrical with respect to the plane of symmetry of the secondary corrugation 10.

In the embodiment illustrated in FIG. 2, the central portion of the internal face 16 of the secondary corrugation 10 is delimited on either side of the apex 18 by points of inflection formed by said internal face 16 of the secondary corrugation 10. Thus, the bearing surface 21 covers the internal face 16 of the secondary corrugation 10 from a first point of inflection located on one side of the apex 18 of the secondary corrugation 10 as far as the point of inflection located on the other side of the secondary corrugation 10 with respect to said apex 18.

The cooperation between the bearing surface 21 and the internal face 16 of the secondary corrugation 10 makes it possible to keep the primary reinforcing member 20 in position on the secondary corrugation 10 opposite the external face 17 of the primary corrugation 14. Furthermore, this cooperation makes it possible to offer the primary reinforcing member 20 a purchase so that said primary reinforcing member 20 can reinforce the primary corrugation 14, as explained below.

The reinforcing surface 22 faces toward the external face 17 of the primary corrugation 14. In a similar way to the shape complementarity between the internal face 16 of the secondary corrugation 10 and the bearing surface 21 the reinforcing surface 22 has a shape complementary to the shape of the external face 17 of the primary corrugation 14. Thus, the reinforcing surface 22 has a convexity facing toward the external face 17 of the primary corrugation 14. Furthermore, the reinforcing surface 22 has a central portion whose radius of curvature is identical to the radius of curvature of the central portion of the external face 17 of the primary corrugation 14. Said central portions are symmetrical with respect to the plane of symmetry of the primary corrugation 14. The central portion of the external face 17 includes a point of said external face 17 located in line with the apex 19 of the primary corrugation 14 and is delimited, on either side of said apex 19, by points of inflection of the external face 17 of the primary corrugation 14.

In order to facilitate mounting of the primary sealed membrane 5 in the tank, a clearance separating the reinforcing surface 22 and the external face 17 of the primary corrugation 14 may be provided. Such a clearance makes it possible to accommodate assembly and mounting tolerances of the primary sealed membrane 5.

The thickness of the primary reinforcing member 20 at a location of said primary reinforcing member 20 is defined as the minimum distance separating the bearing surface 21 and the reinforcing surface 22 at said location. The primary reinforcing member 20 has a maximum thickness in its middle, that is to say at its plane of symmetry. The thickness of the primary reinforcing member 20 decreases from the middle of the primary reinforcing member 20 toward its ends 23. The ends 23 comprise a planar surface 24 connecting the reinforcing surface 22 and the bearing surface 21.

In FIG. 2, the planar surface 24 is at a distance along the thickness direction of the tank wall from the planar portions 11 of the secondary sealed membrane 3. Thus, a base of the secondary corrugation 10, that is to say the portions of the secondary corrugation 10 located on either side of the central portion of said secondary corrugation 10, is not covered by the primary reinforcing member 20.

The absence of coverage of the base of the secondary corrugation 10 by the primary reinforcing member 20 allows said base of the secondary corrugation 10 to deform in response to stresses such as a tensile force associated with the thermal contraction or with the deformation of the hull girder of the ship. hi other words, the secondary corrugation can deform in order to absorb the deformations of the secondary sealing membrane 3, without this deformation being hindered by the primary reinforcing member 20.

In one embodiment, which is not illustrated, this deformation is possible because of the difference in radius of curvature between the bearing surface 21 and the internal face 16 of the secondary corrugation 10, there being a clearance which separates the base of the secondary corrugation 10 and the bearing surface 21 in order to allow the deformation without hindrance of the secondary corrugation 10.

Such a clearance separating the bearing surface 21 and the internal face 16 of the secondary corrugation 10 is dimensioned as a function of several parameters. This clearance is dimensioned as a function of manufacturing and mounting tolerances of the primary reinforcing member 20 and of the secondary corrugation 10. This clearance is also dimensioned as a function of the behavior in thermal contraction of the primary reinforcing member 20 as well as the behavior in deformation of the secondary corrugation 10. The behavior in deformation of the secondary corrugation 10 is determined as a function of the behavior in thermal contraction of the secondary corrugation 10 and the behavior of said secondary corrugation 10 under the effect of the stresses which may occur in the tank. Typically, this clearance is preferably dimensioned in order to satisfy the following equation:

$$\text{Clearance} > \text{tol} + TC_{reinf} - Ouv_{seccor},$$

in which tol represents the manufacturing and mounting tolerances of the primary reinforcing member 20 and of the secondary corrugation 10, $TC_{reinf}$ represents the dimensional variation of the primary reinforcing member 20 under the effect of the thermal contraction, for example between a state of the secondary corrugation 10 in a tank at ambient temperature and a state of the secondary corrugation 10 when the tank is filled with LNG, and $Ouv_{secor}$ represents the dimensional variation of the secondary corrugation 10 resulting from the thermal contraction and the stresses in the tank. Such a clearance allows freedom of deformation of the secondary corrugation 10 with respect to the primary reinforcing member 20, the secondary corrugation 10 being capable of deforming without being constrained by the bearing surface 21 of the primary reinforcing member 20.

In this first embodiment, the primary reinforcing member 20 is solid. During a deformation of the primary corrugation 14, the reinforcing surface 22 of the primary reinforcing member 20 supports the primary corrugation 14 and thus limits its deformation as well as the degradation which may result from said deformation. Furthermore, the shape complementarity between the reinforcing surface 22 and the external face 17 of the primary corrugation 14 uniformly allows this reinforcement of the primary corrugation 14.

In this first embodiment, a secondary reinforcing member 25 is accommodated under the secondary corrugation 10. This secondary reinforcing member 25 has a planar external wall 26 resting on the secondary thermally insulating barrier 2. This secondary reinforcing member 25 furthermore has an envelope 27 extending above the external wall 26. This envelope 27 matches the shape of an external face 28 of the secondary corrugation 10. The external face 28 of the secondary corrugation 10 is in contact with the secondary reinforcing member 25. In a similar way to its cooperation with the primary reinforcing member 20, the external face 28 of the secondary corrugation 10 has a central portion which cooperates with the secondary reinforcing member 25, said central portion containing a point of the external face 28 of the secondary corrugation 10 located in line with the apex 18 and being delimited on either side of said apex by the points of inflection of said external face 28.

The secondary reinforcing member 25 is hollow. It thus allows circulation of gas, for example an inert gas such as nitrogen, in the secondary thermally insulating barrier 2. Furthermore, the secondary reinforcing member 25 comprises internal webs 29 making it possible to reinforce said secondary reinforcing member 25.

During a deformation of the primary corrugation 14, the primary reinforcing member 20 is supported by the cooperation between the bearing surface 21 and the secondary corrugation 10. The internal face 16 of the secondary corrugation 10, reinforced by the secondary reinforcing member 25, forms a solid and reliable bearing surface for the primary reinforcing member 20, allowing the primary reinforcing member 20 to reinforce the primary corrugation 14 reliably.

Figure 3:
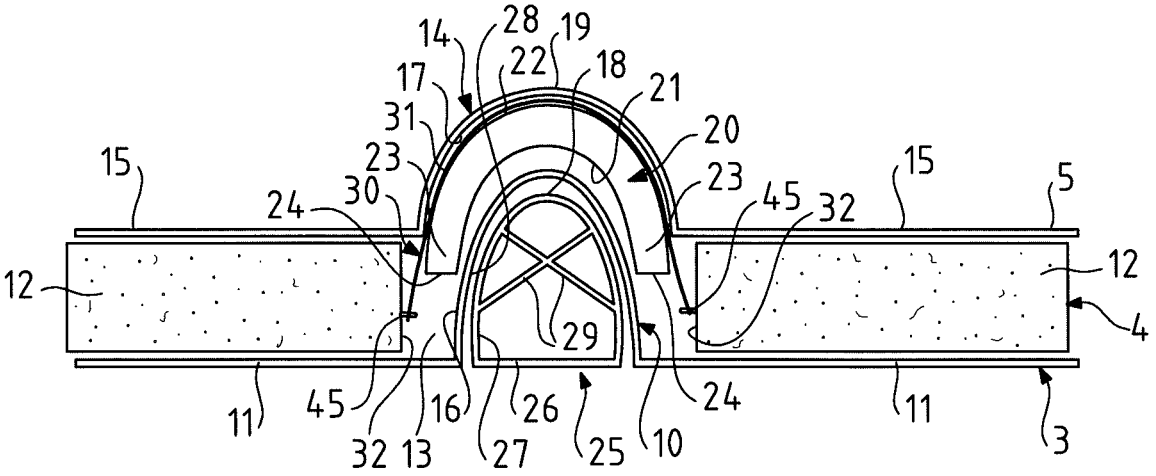
FIG. 3 is a detail sectional view of a sealed and thermally insulating tank as illustrated in FIG. 1, furthermore comprising a primary reinforcing member according to a first variant of the first embodiment.
Figure 4:
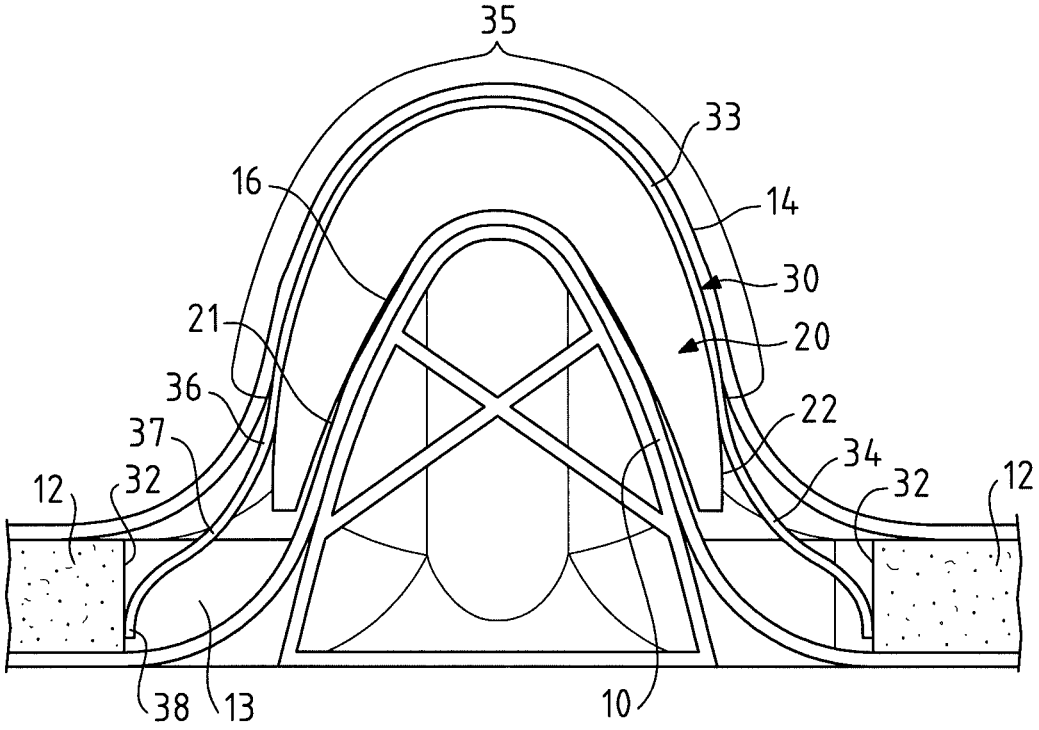
FIG. 4 is a detail sectional view of a sealed and thermally insulating tank as illustrated in FIG. 1, furthermore comprising a primary reinforcing member according to a second variant of the first embodiment.
Figure 5:
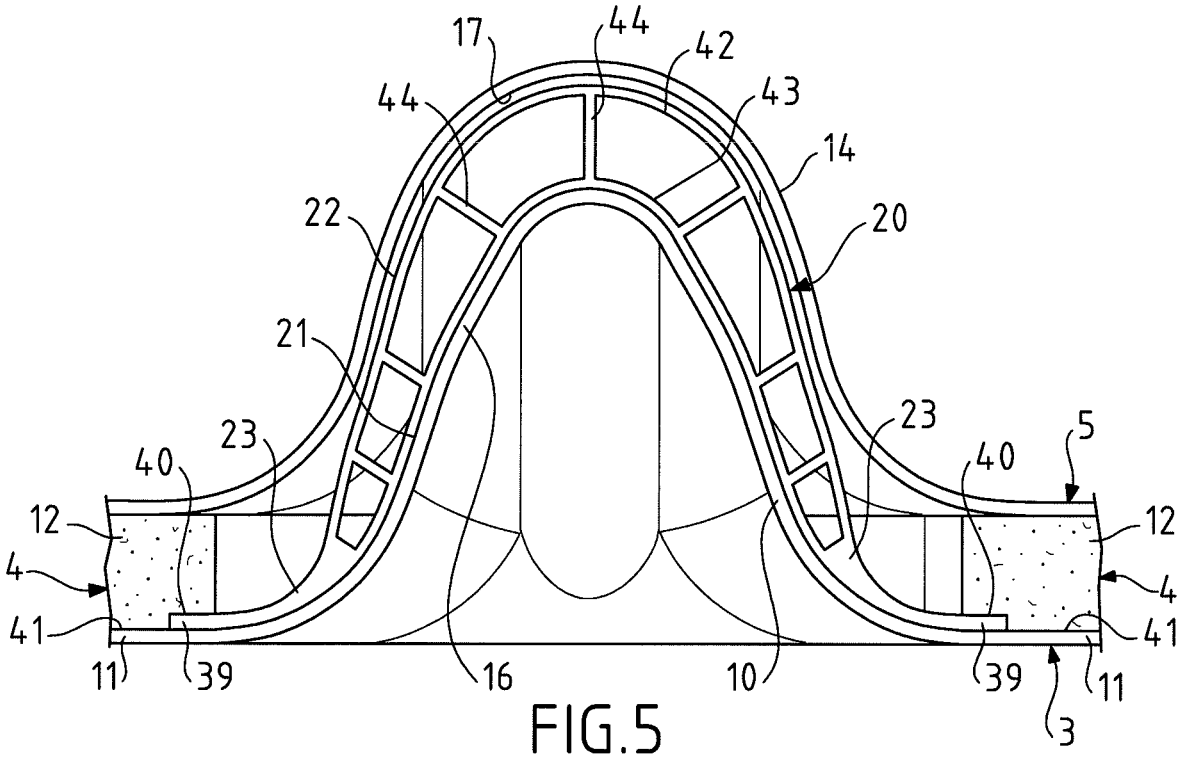
FIG. 5 is a detail sectional view of a sealed and thermally insulating tank as illustrated in FIG. 1, furthermore comprising a primary reinforcing member according to a second embodiment.

In the description of FIGS. 3 to 5 below, the elements which are the same or fulfill the same function as the elements described above with reference to FIGS. 1 and 2 have the same reference.

FIG. 3 illustrates a first alternative embodiment of the primary reinforcing member 20. Some elements illustrated in FIG. 3 are intentionally represented with spacings, it being understood that the spacings are present only in order to make FIG. 3 easier to read.

In this first variant, a holding member 30 cooperates with the primary reinforcing member 20 in order to keep it in position on the secondary corrugation 10. The holding member 30 comprises a flexible band 31. The ends of this flexible band 31 are anchored on the primary thermally insulating barrier 4 on either side of the secondary corrugation 10. More particularly, the ends of the flexible band 31 are anchored on side edges 32 of the rigid plates 12 of the primary thermally insulating barrier 4, said side edges 32 delimiting the passages 13 in which the secondary corrugations 10 are accommodated.

These ends of the flexible band 31 may be anchored on the primary thermally insulating barrier 4 in a number of ways, for example by means of staples 45, screws, nails or any other suitable means.

The flexible band 31 is interposed between the external face 17 of the primary corrugation 14 and the reinforcing surface 22. The flexible band 31 covers the reinforcing surface 22 of the primary reinforcing member 20. This flexible band 31 is prestressed so as to exert a purchase on the primary reinforcing member 20 in the direction of the secondary corrugation 10. The shape complementarity between the bearing surface 21 and the internal face 16 of the secondary corrugation 10 makes it possible to ensure that the primary reinforcing member 20 is correctly positioned on the secondary corrugation 10 under the effect of this purchase exerted by the flexible band 31.

Such a flexible band 31 may be made from a number of materials.

In one preferred embodiment, this flexible band 31 is manufactured from fabric, for example from a textile such as cotton, on the basis of mineral fibers, for example from glass fiber, or from synthetic fibers (PA, PE, PEI, . . . ). Such a flexible band 31 made of fabric is tensioned during the anchoring of its ends on the primary thermally insulating barrier 4, thus allowing the primary reinforcing member 20 to bear on the second corrugation 10.

In one embodiment, the flexible band 31 is made from resilient material, for example from rubber or any other material.

FIG. 4 represents a second alternative embodiment of the first embodiment of the primary reinforcing member 20. This second variant differs from the first variant, illustrated in FIG. 3, in that the flexible band 31 is a metal band 33 whose ends form resilient feet 34.

The metal band 33 comprises a central portion 35 matching the shape of the reinforcing surface 22 of the primary reinforcing member 20. The resilient feet 34 project laterally from the ends of the central portion 35 in the direction of the side edges 32 of the rigid plates 12 of the primary thermally insulating barrier 4. These resilient feet 34 have an "S" shape in section so as to comprise a portion 36 connecting with the central portion 35, said connecting portion 36 continuing the end of the corresponding central portion, a spacing portion 37 extending from the connecting portion 36 in the direction of the side edges 32, and a bearing portion 38 extending from the spacing portion 37 and arranged bearing resiliently against the side edges 32.

These resilient feet 34 are arranged so as to bear on the side edges 32 and keep the metal band 33 in position bearing on the secondary corrugation 10. Thus, the metal band 33 keeps the primary reinforcing member 20 in position on the internal face 16 of the secondary corrugation 10 by bearing and friction of the resilient feet 34 on the side edges 32 delimiting the passage 13.

In one alternative embodiment, which is not represented, the resilient feet 34 are arranged so as to bear in a bore of the primary thermally insulating barrier 4. Such a bore may be formed on an internal face of the rigid plate 12, said internal face of the rigid plate 12 facing toward the primary sealed membrane 5. This bore may also be formed on an external face of the rigid plate 12, said external face facing toward the secondary sealed membrane 3.

FIG. 5 illustrates a second embodiment of the primary reinforcing member 20. This second embodiment of the primary reinforcing member 20 differs from the first embodiment, illustrated above with reference to FIGS. 2 to 4, in that the ends 23 of the primary reinforcing member 20 form planar feet 39. Furthermore, the bearing surface 21 of the primary reinforcing member 20 matches all of the internal face 16 of the secondary corrugation 12, so that the planar feet 39 partially cover a planar portion 11 of the secondary sealed membrane 3. In other words, the primary reinforcing member 20 has a bearing surface 21 whose radius of curvature is identical to the radius of curvature of the internal face 16 of the secondary corrugation 10 and extends on either side of the secondary corrugation 10 while resting on the secondary sealed membrane 3 either side of the secondary corrugation 10.

In this second embodiment, the primary thermally insulating barrier 4 comprises a bore 40. This bore 40 is formed on a lower face 41 of the primary thermally insulating barrier 4 so as to create a space between said primary thermally insulating barrier 4 and the secondary sealed membrane 3. The planar feet 39 of the primary reinforcing member 20 are accommodated in this bore 40 so that said feet 39 are interposed between the primary thermally insulating barrier 4 and the secondary sealed membrane 3. Thus, the primary reinforcing member 20 is kept in position by abutment on the bottom of the bore 40 of the primary thermally insulating barrier 4 and bearing on a planar portion 11 of the secondary sealed membrane 3 and therefore bearing indirectly on the secondary thermally insulating barrier 2.

In the context of a primary thermally insulating barrier 4 consisting of rigid plywood plates 12, the bore 40 is for example formed on the external face of these rigid plates 12, that is to say on the face resting on the planar portions 11 of the secondary sealed membrane 3.

This indirect bearing of the primary reinforcing member 20 on the secondary thermally insulating barrier 2 makes it possible to keep the primary reinforcing member 20 in position. In particular, during a deformation of the primary corrugation 14, the bearing of the primary reinforcing member 20 on the secondary sealed membrane 3 and on the secondary thermally insulating barrier 2 allows the primary reinforcing member 20 to fulfill the function of reinforcing the primary corrugation 14 without stressing the secondary corrugation 10. In other words, the bearing of the primary reinforcing member 20 in this second embodiment is ensured by the feet 39 resting on the planar portion 11 of the secondary sealed member 3, and not by the bearing surface 21 bearing on the secondary corrugation 10, as in the first embodiment.

In a manner which is not represented, in this second embodiment it is possible to provide a clearance separating the bearing surface 21 of the primary reinforcing member 20 and the internal face 16 of the secondary corrugation 10. Such a clearance is produced in a similar way to the clearance described above with reference to the first embodiment in order to allow deformation of the secondary corrugation 10 without hindrance of the primary reinforcing member 20.

Thus, the secondary corrugation 10 is less stressed, or even not stressed, in order to allow the primary reinforcing member 20 to fulfill its function of reinforcing the primary corrugation 14. Consequently, in this second embodiment, it may be possible not to use a secondary reinforcing member 25, as is illustrated in FIG. 5.

Furthermore, in this second embodiment, the primary reinforcing member 20 is hollow. An internal wall 42 forms the reinforcing surface 22 and an external wall 43 forms the bearing surface 21, these walls 42 and 43 being connected at the ends of the primary reinforcing member 20 in order to form planar feet 39. Internal webs 44 connect the internal wall 42 and the external wall 43 in order to reinforce this hollow primary reinforcing member 20. These internal webs 44 extend, for example, substantially perpendicularly to the external wall 43.

The complementarity between the internal face 16 of the secondary corrugation 10 and the bearing face 21 of the primary reinforcing member 20 makes it possible to ensure lateral holding of the primary reinforcing member 20. Typically, this complementarity makes it possible to center the primary reinforcing member 20 on the secondary corrugation 10.

As an alternative and in a manner which is not represented, the primary reinforcing member 20 is composed of two primary half-reinforcements separated at the plane passing through the apices 18, 19 of the primary 14 and secondary 10 corrugations in order to allow deformation without hindrance of the secondary corrugation 10. The half-reinforcements may be free at the apices 18, 19 of the corrugations 10, 14 and locked in translation by means of the foot 39 accommodated in the bore 40. The two half-reinforcements may also be connected by an axial pivoting link perpendicular to the section plane of FIG. 5.

The technique described above for producing a sealed and thermally insulating tank may be used in various types of reservoirs, for example in order to form the primary sealing membrane of an LNG reservoir in an onshore facility or in a floating construction, such as a methane carrier ship or the like.

Figure 6:
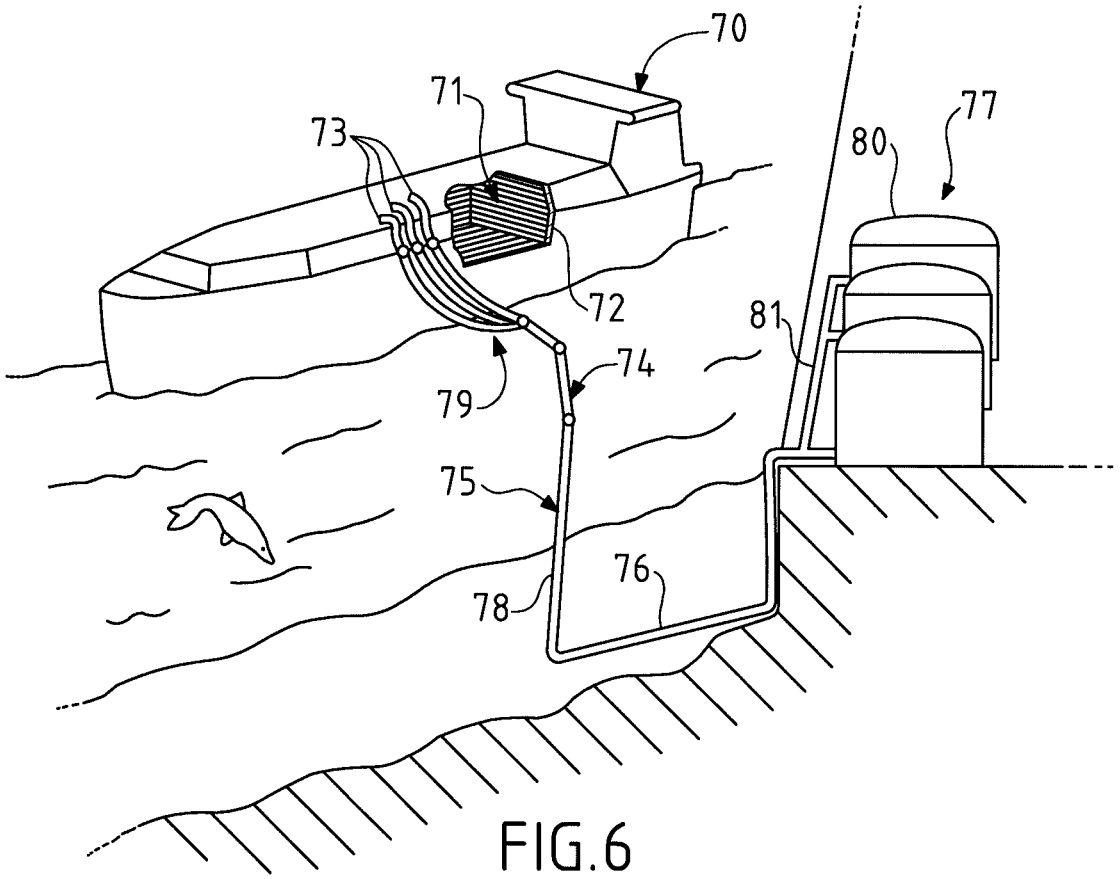
FIG. 6 is a schematic cutaway view of a tank of a methane carrier ship and of a terminal for loading/unloading this tank.

Referring to FIG. 6, a cutaway view of a methane carrier ship 70 shows a sealed and insulated tank 71 of prismatic overall shape mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

In a manner known per se, loading/unloading pipelines 73 arranged on the upper deck of the ship may be connected by means of suitable connectors to a maritime or port terminal in order to transfer an LNG cargo from or to the tank 71.

FIG. 6 represents an example of a maritime terminal comprising a loading and unloading station 75, an underwater pipe 76 and an onshore installation 77. The loading and unloading station 75 is a fixed offshore installation comprising a mobile arm 74 and a tower 78, which supports the mobile arm 74. The mobile arm 74 carries a bundle of insulated flexible tubes 79 which can be connected to the loading/unloading pipelines 73. The orientable mobile arm 74 adapts to all the gauges of methane carriers. A connecting pipe (not represented) extends inside the tower 78. The loading and unloading station 75 makes it possible to load and unload the methane carrier 70 from or to the onshore installation 77. The latter comprises liquefied gas storage tanks 80 and connecting pipes 81 connected by the underwater pipe 76 to the loading or unloading station 75. The underwater pipe 76 makes it possible to transfer liquefied gas between the loading or unloading station 75 and the onshore installation 77 over a large distance, for example 5 km, which makes it possible to keep the methane carrier ship 70 at a large distance from the shore during the loading and unloading operations.

In order to generate the pressure necessary for transferring the liquefied gas, pumps on-board the ship 70 and/or pumps fitted in the onshore installation 77 and/or pumps fitted in the loading and unloading station 75 are used.

Although the invention has been described in connection with several particular embodiments, it is clear that it is in no way limited thereto and that it comprises all the technical equivalents of the means described as well as their combinations, if the latter fall within the scope of the invention.

The use of the verb "comprise" or "include" and its conjugated forms does not exclude the presence of elements or steps other than those mentioned in a claim. The use of the indefinite article "a" or "an" for an element or a step does not, unless otherwise mentioned, exclude the presence of a plurality of such elements or steps.

In the claims, any reference in parentheses should not be interpreted as a limitation of the claim.

The invention claimed is:

1. A sealed and thermally insulating tank intended to be installed in a supporting structure, the tank comprising, from an exterior of the tank toward an interior of the tank:

a secondary insulation barrier configured to be anchored on the supporting structure;

a secondary sealing membrane resting on the secondary insulation barrier;

a primary insulation barrier resting on the secondary sealing membrane; and a primary sealing membrane resting on the primary insulation barrier;

wherein the primary sealing membrane comprises primary corrugations projecting toward the interior of the tank and the secondary sealing membrane comprises secondary corrugations projecting toward the interior of the tank, the primary corrugations and the secondary corrugations being superimposed along a thickness direction;

wherein the primary insulation barrier has passages and the secondary corrugations are accommodated in the passages, a dimension of the primary insulation barrier along the thickness direction being less than a dimension of the secondary corrugations taken along the thickness direction so that the secondary corrugations extend through the passages and are partially accommodated in the primary corrugations;

wherein the tank further comprises a primary reinforcing member interposed along the thickness direction between a superimposed secondary corrugation and primary corrugation so as to reinforce the primary corrugation; and wherein the primary reinforcing member comprises a pair of feet projecting laterally from ends of the primary reinforcing member, the feet being accommodated in respective bores of the primary insulation barrier so as to block the primary reinforcing member in displacement along the thickness direction of the tank.

2. The tank as claimed in claim 1, wherein the primary reinforcing member has a concave bearing surface, a concavity of which faces the secondary corrugation, the bearing surface matching an internal face of the secondary corrugation located opposite the concave bearing surface.

3. The tank as claimed in claim 2, wherein the bearing surface has a radius of curvature identical or similar to a radius of curvature of the internal face of the secondary corrugation.

4. The tank as claimed in claim 2, wherein a radius of curvature of the bearing surface is such that the bearing surface partially covers the internal face of the secondary corrugation.

5. The tank as claimed in claim 1, wherein the primary reinforcing member has a convex reinforcing surface, a convexity of which faces the primary corrugation and has a radius of curvature matching a radius of curvature of an external face of the primary corrugation.

6. The tank as claimed in claim 1, wherein a thickness of the primary reinforcing member decreases in a direction of lateral ends of the primary reinforcing member.

7. The tank as claimed in claim 1, wherein the primary reinforcing member is hollow and comprises internal reinforcing webs.

8. The tank as claimed in claim 1, further comprising:

a secondary reinforcing member interposed along the thickness direction of the tank between the secondary corrugation projecting into the primary corrugation and the secondary insulation barrier so as to reinforce the secondary corrugation projecting into the primary corrugation.

9. The tank as claimed in claim 8, wherein the secondary reinforcing member has an external shape matching an internal shape of a portion of the secondary corrugation projecting into the primary corrugation.

10. The tank as claimed in claim 1, wherein the tank comprises multiple primary reinforcing members, each primary reinforcing member interposed along the thickness direction between one of the secondary corrugations and one of the primary corrugations.

11. A ship configured to transport a cold liquid product, the ship comprising a double hull and a tank as claimed in claim 1 arranged in the double hull.

12. A transfer system for a cold liquid product, the system comprising a ship as claimed in claim 11, one or more insulated pipelines arranged so as to connect the tank installed in the double hull of the ship to a floating or onshore storage facility, and a pump configured to deliver a flow of the cold liquid product through the one or more insulated pipelines between the floating or onshore storage facility and the double hull of the ship.

13. A sealed and thermally insulating tank intended to be installed in a supporting structure, the tank comprising, from an exterior of the tank toward an interior of the tank:

a secondary insulation barrier configured to be anchored on the supporting structure;

a secondary sealing membrane resting on the secondary insulation barrier;

a primary insulation barrier resting on the secondary sealing membrane; and a primary sealing membrane resting on the primary insulation barrier;

wherein the primary sealing membrane comprises primary corrugations projecting toward the interior of the tank and the secondary sealing membrane comprises secondary corrugations projecting toward the interior of the tank, the primary corrugations and the secondary corrugations being superimposed along a thickness direction;

wherein the primary insulation barrier has passages and the secondary corrugations are accommodated in the passages, a dimension of the primary insulation barrier along the thickness direction being less than a dimension of the secondary corrugations taken along the thickness direction so that the secondary corrugations extend through the passages and are partially accommodated in the primary corrugations;

wherein the tank further comprises a primary reinforcing member interposed along the thickness direction between a superimposed secondary corrugation and primary corrugation so as to reinforce the primary corrugation; and wherein the tank further comprises a secondary reinforcing member interposed along the thickness direction of the tank between the secondary corrugation projecting into the primary corrugation and the secondary insulation barrier so as to reinforce the secondary corrugation projecting into the primary corrugation.

14. The tank as claimed in claim 13, wherein the primary reinforcing member has a concave bearing surface, a concavity of which faces the secondary corrugation, the bearing surface matching an internal face of the secondary corrugation located opposite the concave bearing surface.

15. The tank as claimed in claim 13, wherein the primary reinforcing member comprises a pair of feet projecting laterally from ends of the primary reinforcing member, the feet being accommodated in respective bores of the primary insulation barrier so as to block the primary reinforcing member in displacement along the thickness direction of the tank.

16. The tank as claimed in claim 15, wherein the secondary reinforcing member has an external shape matching an internal shape of a portion of the secondary corrugation projecting into the primary corrugation.

17. The tank as claimed in claim 13, wherein the tank comprises multiple primary reinforcing members, each primary reinforcing member interposed along the thickness direction between one of the secondary corrugations and one of the primary corrugations.

18. A ship configured to transport a cold liquid product, the ship comprising a double hull and a tank as claimed in claim 13 arranged in the double hull.

19. A transfer system for a cold liquid product, the system comprising a ship as claimed in claim 18, one or more insulated pipelines arranged so as to connect the tank installed in the double hull of the ship to a floating or onshore storage facility, and a pump configured to deliver a flow of the cold liquid product through the one or more insulated pipelines between the floating or onshore storage facility and the double hull of the ship.

20. A method for loading or unloading a ship comprising:

conveying a cold liquid product through one or more insulated pipelines between a floating or onshore storage facility and a tank of the ship;

wherein the tank comprises, from an exterior of the tank toward an interior of the tank:

a secondary insulation barrier;

a secondary sealing membrane resting on the secondary insulation barrier;

a primary insulation barrier resting on the secondary sealing membrane; and a primary sealing membrane resting on the primary insulation barrier;

wherein the primary sealing membrane comprises primary corrugations projecting toward the interior of the tank and the secondary sealing membrane comprises secondary corrugations projecting toward the interior of the tank, the primary corrugations and the secondary corrugations being superimposed along a thickness direction;

wherein the primary insulation barrier has passages and the secondary corrugations are accommodated in the passages, a dimension of the primary insulation barrier along the thickness direction being less than a dimension of the secondary corrugations taken along the thickness direction so that the secondary corrugations extend through the passages and are partially accommodated in the primary corrugations;

wherein the tank further comprises a primary reinforcing member interposed along the thickness direction between a superimposed secondary corrugation and primary corrugation so as to reinforce the primary corrugation; and wherein the primary reinforcing member comprises a pair of feet projecting laterally from ends of the primary reinforcing member, the feet being accommodated in respective bores of the primary insulation barrier so as to block the primary reinforcing member in displacement along the thickness direction of the tank.

21. The method as claimed in claim 20, wherein the primary reinforcing member is hollow and comprises internal reinforcing webs.

22. The method as claimed in claim 20, wherein the primary reinforcing member has a concave bearing surface, a concavity of which faces the secondary corrugation, the bearing surface matching an internal face of the secondary corrugation located opposite the concave bearing surface.

23. The method as claimed in claim 20, wherein the primary reinforcing member has a convex reinforcing surface, a convexity of which faces the primary corrugation and has a radius of curvature matching a radius of curvature of an external face of the primary corrugation.

24. A sealed and thermally insulating tank intended to be installed in a supporting structure, the tank comprising, from an exterior of the tank toward an interior of the tank:

a secondary insulation barrier configured to be anchored on the supporting structure;

a secondary sealing membrane resting on the secondary insulation barrier;

a primary insulation barrier resting on the secondary sealing membrane; and a primary sealing membrane resting on the primary insulation barrier;

wherein the primary sealing membrane comprises primary corrugations projecting toward the interior of the tank and the secondary sealing membrane comprises secondary corrugations projecting toward the interior of the tank, the primary corrugations and the secondary corrugations being superimposed along a thickness direction;

wherein the primary insulation barrier has passages and the secondary corrugations are accommodated in the passages, a dimension of the primary insulation barrier along the thickness direction being less than a dimension of the secondary corrugations taken along the thickness direction so that the secondary corrugations extend through the passages and are partially accommodated in the primary corrugations;

wherein the tank further comprises a primary reinforcing member interposed along the thickness direction between a superimposed secondary corrugation and primary corrugation so as to reinforce the primary corrugation;

wherein the tank further comprises a holding device arranged to exert a force on the primary reinforcing member in a direction of the secondary corrugation so as to keep the primary reinforcing member bearing against the secondary corrugation; and wherein the holding device comprises a flexible member anchored on the primary insulation barrier and connected to the primary reinforcing member so as to exert the force in the direction of the secondary corrugation on the primary reinforcing member.

25. The tank as claimed in claim 24, wherein the primary reinforcing member has a concave bearing surface, a concavity of which faces the secondary corrugation, the bearing surface matching an internal face of the secondary corrugation located opposite the concave bearing surface.

26. The tank as claimed in claim 25, wherein the bearing surface has a radius of curvature identical or similar to a radius of curvature of the internal face of the secondary corrugation.

27. The tank as claimed in claim 24, wherein the primary reinforcing member has a convex reinforcing surface, a convexity of which faces the primary corrugation and has a radius of curvature matching a radius of curvature of an external face of the primary corrugation.

28. The tank as claimed in claim 24, wherein the primary reinforcing member comprises a pair of feet projecting laterally from ends of the primary reinforcing member, the feet being accommodated in respective bores of the primary insulation barrier so as to block the primary reinforcing member in displacement along the thickness direction of the tank.

29. The tank as claimed in claim 24, further comprising:

a secondary reinforcing member interposed along the thickness direction of the tank between the secondary corrugation projecting into the primary corrugation and the secondary insulation barrier so as to reinforce the secondary corrugation projecting into the primary corrugation.

30. A ship configured to transport a cold liquid product, the ship comprising a double hull and a tank as claimed in claim 24 arranged in the double hull.

31. A transfer system for a cold liquid product, the system comprising a ship as claimed in claim 30, one or more insulated pipelines arranged so as to connect the tank installed in the double hull of the ship to a floating or onshore storage facility, and a pump configured to deliver a flow of the cold liquid product through the one or more insulated pipelines between the floating or onshore storage facility and the double hull of the ship.

32. The tank as claimed in claim 24, wherein the tank comprises multiple primary reinforcing members, each primary reinforcing member interposed along the thickness direction between one of the secondary corrugations and one of the primary corrugations.

* * * * *